US007507378B2

(12) United States Patent
Reichenbach et al.

(10) Patent No.: US 7,507,378 B2
(45) Date of Patent: Mar. 24, 2009

(54) COLLECTION ASSEMBLY

(75) Inventors: Judith A. Reichenbach, Pompton Plains, NJ (US); Danielle DeSalvo, Butler, NJ (US); Norman J. Hutton, Franklin Lakes, NJ (US); Michael Iskra, Bridgewater, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 828 days.

(21) Appl. No.: 10/644,387

(22) Filed: Aug. 20, 2003

(65) Prior Publication Data

US 2004/0079753 A1 Apr. 29, 2004

Related U.S. Application Data

(63) Continuation of application No. 10/114,542, filed on Apr. 1, 2002, now Pat. No. 6,749,078, and a continuation-in-part of application No. 09/933,653, filed on Aug. 21, 2001, now Pat. No. 6,651,835.

(60) Provisional application No. 60/405,048, filed on Aug. 20, 2002.

(51) Int. Cl.
*B01L 3/00* (2006.01)

(52) U.S. Cl. ..... 422/102; 215/10; 426/180

(58) Field of Classification Search ..... 422/99, 422/102, 104; 215/10, 12.1, 13.1; 436/180
See application file for complete search history.

(56) References Cited

U.S. PATENT DOCUMENTS

| | | | | |
|---|---|---|---|---|
| 4,869,812 | A | 9/1989 | Schoendorfer et al. | |
| 5,871,700 | A * | 2/1999 | Konrad | 422/102 |
| 5,888,831 | A * | 3/1999 | Gautsch | 436/177 |
| 6,027,694 | A * | 2/2000 | Boulton et al. | 422/102 |
| 6,083,761 | A * | 7/2000 | Kedar et al. | 436/178 |
| 6,612,997 | B1 * | 9/2003 | Hutton | 600/573 |
| 6,651,835 | B2 * | 11/2003 | Iskra | 220/23.87 |
| 6,749,078 | B2 * | 6/2004 | Iskra | 220/23.87 |
| 6,805,842 | B1 * | 10/2004 | Bodner et al. | 422/102 |

* cited by examiner

*Primary Examiner*—Jill Warden
*Assistant Examiner*—Dwayne K Handy
(74) *Attorney, Agent, or Firm*—Mark Lindsey

(57) ABSTRACT

A plurality of container assemblies are provided. Each container assembly has substantially identical external dimensions. However, the internal volumes of certain container assemblies differ from the internal volumes of other container assemblies. The container assemblies are configured in accordance with the required volume of material to be collected or maintained in the respective container assemblies and to enable uniform head spaces despite the different volumes of materials in the respective container assemblies. Each container assembly may have an inner container and an outer container. The inner and outer containers may be assembled together or formed integrally by molding.

33 Claims, 8 Drawing Sheets

COLLECTION ASSEMBLY

RELATED APPLICATIONS

This application claims priority on U.S. Provisional Patent Appl. No. 60/405,048, filed on Aug. 20, 2002 and is a continuation-in-part of pending U.S. patent application Ser. No. 09/933,653 and U.S. patent application Ser. No. 10/114,542.

BACKGROUND OF THE INVENTION

1. Field of the Invention

The invention relates to collection containers, such as collection containers used for collecting specimens of bodily fluid.

2. Description of the Related Art

Tubes are used to collect specimens or samples of bodily fluid. The typical tube includes a cylindrical sidewall with a spherically generated closed bottom and an open top. A closure is mounted to the open top to permit sealing of the tube. The closure typically comprises an elastomeric stopper that is urged into the open top of the tube. The closure also may include a rigid plastic member that retains the elastomeric stopper. The plastic member can be used to manipulate the stopper for placing the closure in the open top of the tube or for removing the closure from the tube. The elastomeric stopper may be formed from a pierceable and resealable material. Some closures also include a layer of foil across the top of the closure for enhanced performance of the closure as a gas or moisture barrier. Tubes typically are formed from either glass or plastic. Glass tubes perform well as gas and moisture barriers, but are more fragile than plastic tubes. Hence, glass tubes may require special handling. Plastic tubes are substantially unbreakable. However, certain plastics may be permeable to gases or moisture.

A sample of fluid collected in a tube typically is sent to a laboratory for analysis. Characteristics of the collected sample may change if the sample is exposed to ambient gases or if vapors produced by the sample are permitted to permeate through the walls of the tube and into the ambient surroundings. Characteristics of the collected sample also may vary after exposure to gas trapped between the surface of the collected fluid sample and the stopper. The volume between the top of the collected sample and the stopper is referred to herein as the head space.

Most laboratory analysis of collected fluid samples are performed with automated or semi-automated equipment. The equipment typically is geared to accommodate tubes of specified outside dimensions. Tubes that are too small may require separate handling, and hence tubes with non-standard outside dimensions may require slower less efficient and more costly analysis of the specimens collected therein. Accordingly, most health care facilities collect specimens in standard sized tubes. However, some tests can be performed with relatively small volumes of a fluid sample. A collection of a small volume sample in a relatively large tube necessarily creates a large head space with a large volume of air above the collected sample. Accordingly, there is a greater probability that characteristics of a small collected sample will vary prior to testing due to interaction or reaction with the relatively large volume of air in the head space.

It is desirable to provide a tube with standard outside dimensions. It is also desirable to collect only the smallest volume of a sample that is required for a particular laboratory analysis. Furthermore, it is desirable to provide a smaller and substantially uniform head space.

SUMMARY OF THE INVENTION

The subject invention is directed to sample collection containers. The sample collection containers have selected outside dimensions to conform with instruments and equipment employed in a laboratory. The sample containers, however, have wall dimensions selected to achieve a small and uniform head space between the top of the collected sample and the bottom of the closure.

The container may be a tube with a substantially cylindrical outer surface. The bottom of the tube may be closed and may have a substantially spherically generated outer surface. The top of the tube is open.

The walls of the container may be of different thicknesses at various locations between the closed bottom of the container and the open top. For example, walls of the container adjacent the open top may have a thickness selected in accordance with strength requirements of the container and/or in accordance with standard dimensions for the closure. The walls of the container spaced from the open top, however, may have a thickness greater than the thickness of the container at the open top. The greater thickness of the container walls at locations spaced from the open top function to reduce the volume of the space in the container. Thus, a small volume of a fluid sample can be collected without significantly increasing the head space and achieving a desirably low sample to head space volume ratio.

The collection container may be formed from a plastic material by a molding process, such as co-injection, two-shot molding or other known process to provide an integral or unitary matrix of plastic between inner and outer surfaces of the container. Alternatively, the collection container may comprise a plurality of nested containers. The nested containers may comprise an outer container of substantially uniform wall thickness and an inner container with a variable wall thickness. The inner container can be slidably inserted into the outer container so that the two containers function as a single container assembly. The variable thickness of the inner container may comprise a thin wall portion adjacent the open top of the inner container and a thick wall portion adjacent the bottom of the inner container. The thickness of the thick wall section of the inner container is selected to achieve a small head space that can be uniform for a range of collected specimens of a particular type and a particular volume. The thin wall section of the inner container may be dimensioned for engagement by at least part of the closure.

The outer surface of the inner container and/or the inner surface of the outer container may be formed with surface configurations to facilitate nesting of the two containers. The surface configurations can include a roughening along at least a portion of the outer surface of the inner container or the inner surface of the outer container. The roughening defines an array of peaks and valleys, and air that would otherwise be trapped between the containers can escape through the valleys as the containers are being assembled. Hence, an air lock is not likely to be created as the inner and outer containers are assembled. Furthermore, compressed air will not exist in the minute spaces defined between the inner and outer containers, and accordingly migration of air through the inner wall of the inner container is substantially reduced or eliminated.

The invention also is directed to a system of containers. All of the containers in the system have uniform outside shapes and dimensions. However, the wall thicknesses of the containers vary among groups of containers within the system. As a result, the volume of fluid that can be collected by the containers in the system varies among at least certain of the containers. The volume is inversely related to the thickness of the walls of the containers. All of the containers within the system, however, provide a substantially uniform head space.

DETAILED DESCRIPTION

Figure 1:
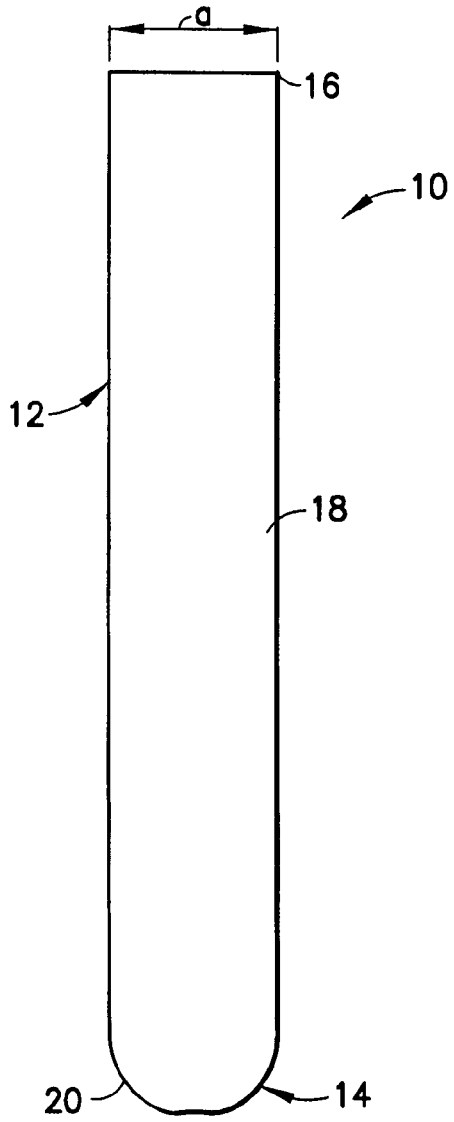
FIG. 1 is a side elevational view of a tubular container in accordance with the subject invention.
Figure 2:
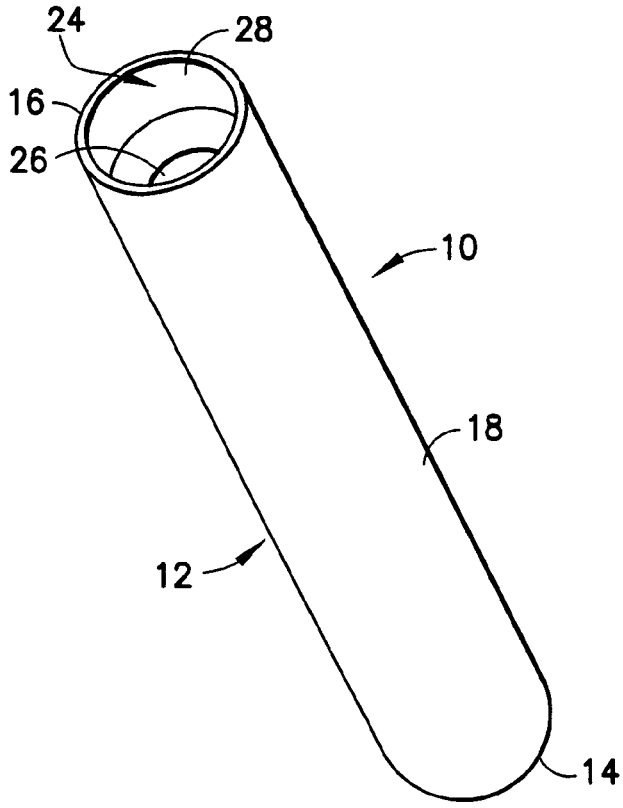
FIG. 2 is a perspective view of the container shown in FIG. 1.
Figure 3:
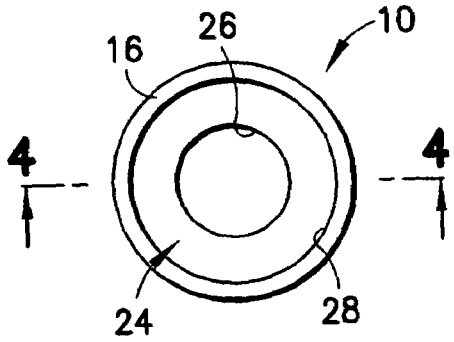
FIG. 3 is a top plan view of the container show in FIGS. 1 and 2.

A container in accordance with the subject invention is identified generally by the numeral 10 in FIGS. 1-4. Container 10 includes a generally tubular sidewall 12, a closed bottom 14 and an open top 16. Tubular sidewall 12 includes a cylindrically generated outer surface 18 defining a diameter "a" as shown in FIG. 1. Closed bottom 14 of container 10 has a substantially spherically generated outer surface 20 characterized by a concave dimple 22 centrally disposed on the closed bottom.

Figure 4:
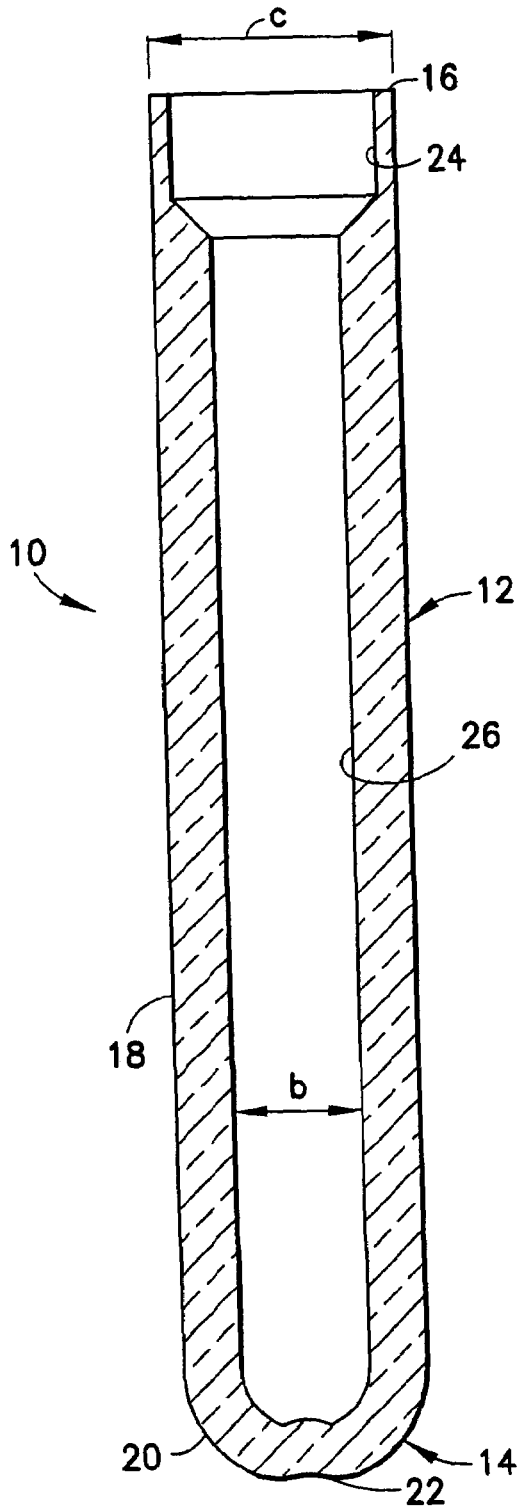
FIG. 4 is a cross-sectional view taken along line 4-4 in FIG. 3.

Tubular sidewall 12 of container 10 is further characterized by an inner surface 24 of substantially stepped cylindrical configuration. In particular, inner surface 24 includes a cross-sectionally small section 26 adjacent bottom end 14 of container 10 and a cross-sectionally large section 28 adjacent open top 16. Cross-sectionally small section 26 has an inside diameter "b" as shown in FIG. 4, while cross-sectionally large section 28 has an inside diameter "c". Inside diameter "c" at cross-sectionally large section 28 is dimensioned to achieve tight engagement with a closure (not shown in FIGS. 1-4). Container 10 is molded unitarily from a plastic material by a molding process.

The stepped inside surface 24 of container 10 enables a small volume of fluid to be collected without altering outside dimensions of container 10. Thus, outside diameter "a" enables container 10 to be used with standardized laboratory equipment. However, the stepped cylindrical inner surface 24 enables a small volume of fluid to be collected in container 10 without an undesirably large head space.

Container 10 may have a sidewall 12 and a bottom wall 14 with thicknesses dimensioned to achieve a volume ranging from about 1 mL to about 4 mL. Fluid samples of these volumes are acceptable for many testing procedures and enable a head space in the range of 5-16 mm (i.e., 0.8-1.5 mL) to be achieved. Tubes of similar construction but with different wall thicknesses and different inside diameters for inner surface 24 can be used to achieve different fluid volumes without significantly affecting the head space. Container 10 can be used with a closure, such as an elastomeric stopper inserted into open top 16. The stopper may function to maintain a vacuum in container 10 so that container 10 can be used for drawing a sample of blood.

Figure 5:
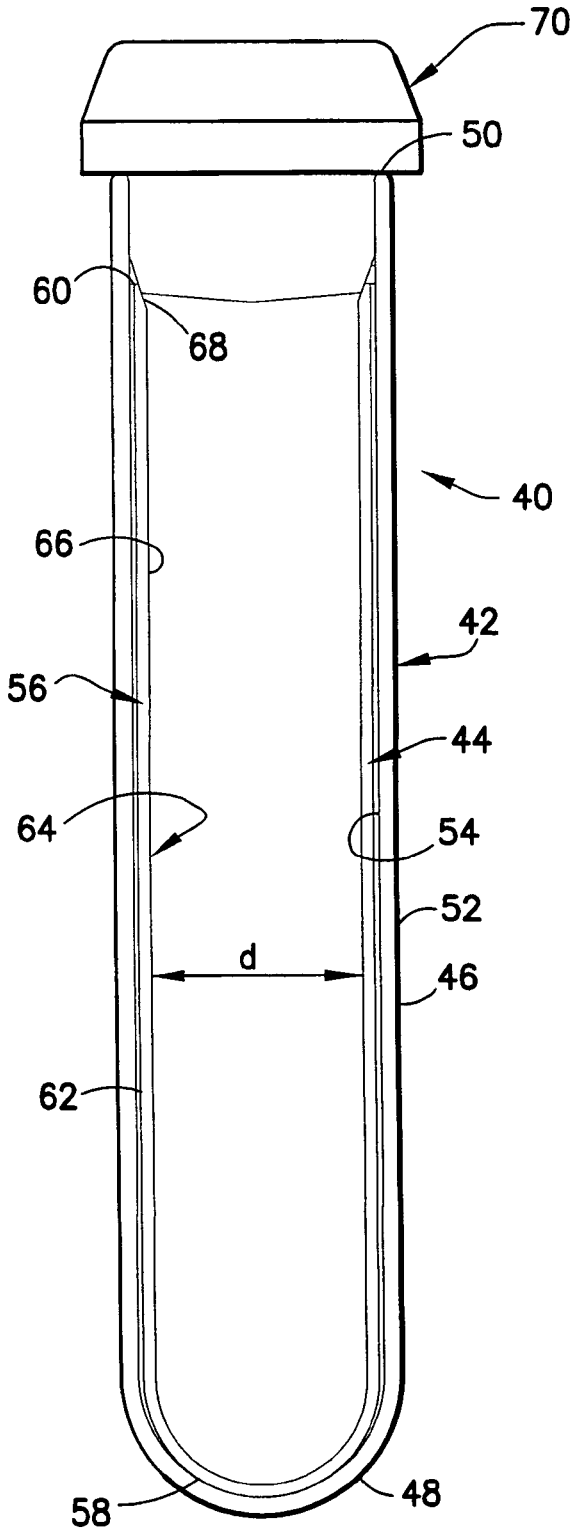
FIG. 5 is a longitudinal cross-sectional view of a second embodiment of a container assembly in accordance with the subject invention.
Figure 6:
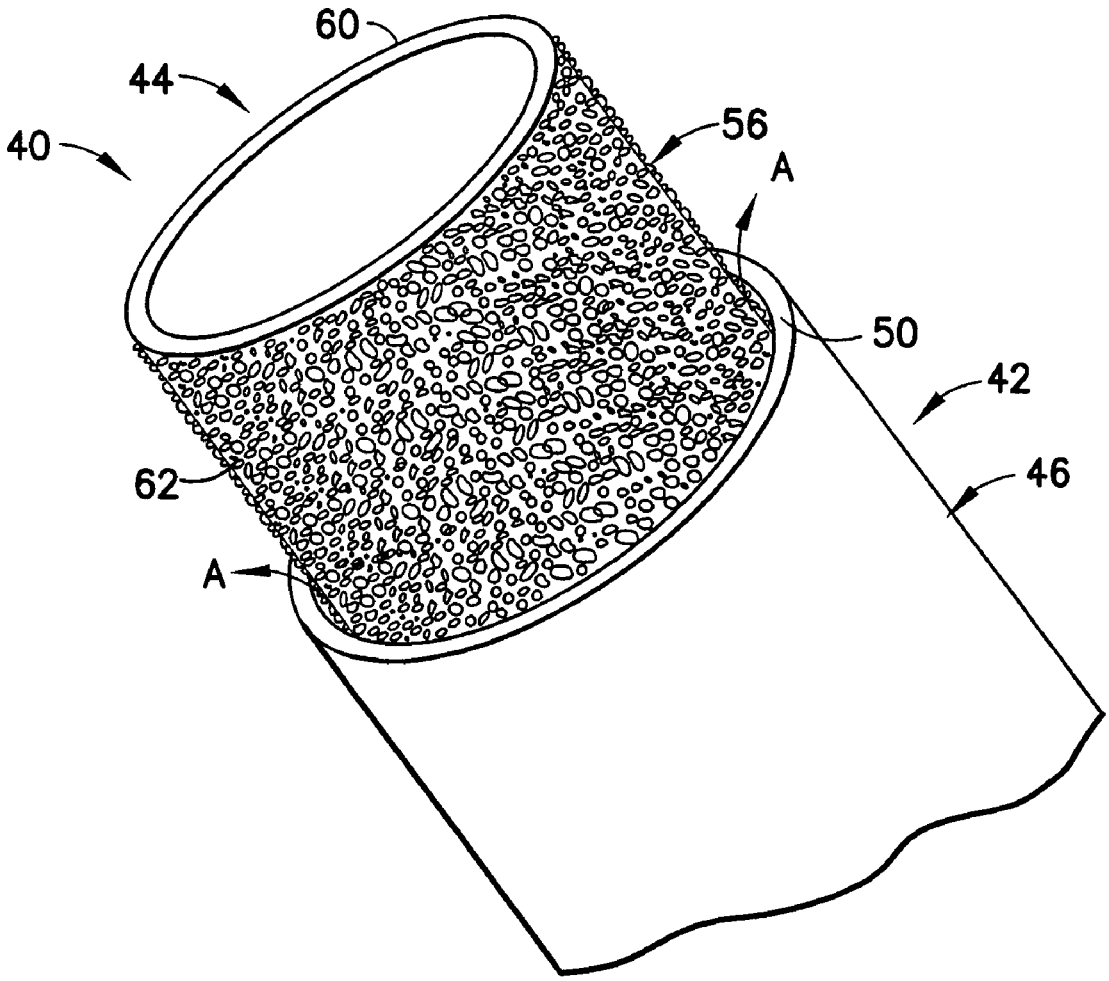
FIG. 6 is an exploded perspective view of the container of FIG. 5.

The embodiment of the invention depicted in FIGS. 1-4 shows tube 10 formed from plastic material by a co-injection process or other molding process familiar to those in the art. For example, an outer portion of tube 10 may be molded from a first plastic and an inner portion may be molded from a second plastic. The co-injection or other molding process achieves an integral or unitary matrix of plastic between inner and outer surfaces 24 and 18. The plastics selected for the inner and outer portions of tube 10 are selected in accordance with specific requirements, such as compatibility with the stored material, liquid impermeability, gas impermeability and such. FIGS. 5-8 show an alternate embodiment where tube assemblies comprise inner and outer tubes. In particular, FIGS. 5 and 6 show a tube assembly 40 with an outer container 42 and an inner container 44. Outer container 42 includes a substantially cylindrical tubular sidewall 46, a closed bottom 48 and an open top 50. Tubular sidewall 46 includes a cylindrically generated outer surface 52 and a cylindrically generated inner surface 54. Outer surface 52 and inner surface 54 of outer tube 42 are of substantially uniform cross-section along the entire length of tubular sidewall 46. Thus, tubular sidewall 46 is of substantially uniform thickness along its length.

Inner tube 44 includes a tubular sidewall 56, a closed bottom 58 and an open top 60. Tubular sidewall 56 has an outer surface 62 and an opposed inner surface 64. A roughened region that defines an array of peaks and valleys extends along at least a portion of the outer surface 62, as shown most clearly in FIG. 6. The diameter defined by the peaks on outer surface 62 of tubular sidewall 56 substantially equals the inside diameter of inner surface 54 on sidewall 46 of outer tube 42. The valleys between the peaks on the roughened outer surface 62 define an outside diameter that is less than the inside diameter of inner surface 54 of sidewall 46 on outer tube 42. The valleys on roughened outer surface 62 define circuitous or tortuous paths that permit an escape of air A as inner tube 44 is being inserted into outer tube 42. Thus, assembly of tubes 42 and 44 is easier and there is no build-up of high pressure air between inner and outer tubes 42 and 44.

Inner surface 64 of inner tube 44 has a substantially cylindrical portion 66 extending up from closed bottom 58 and an outwardly tapered portion 68 adjacent open top 60. Cylindrical portion 66 of inner surface 64 defines an inside diameter "d". Inside diameter "d" is selected to achieve a preferred volume for tube assembly 40. In the illustrated example of FIG. 5, tube assembly 40 accommodates 3.5 ml.

Tube assembly 40 is employed with a closure 70 to seal inner tube 44 and outer tube 42 adjacent the respective open tops 60 and 50, and in some embodiments to maintain a low pressure. Thus, a selected volume of blood can be collected in tube assembly 40 by placing the evacuated interior of tube assembly 40 in communication with a blood vessel. This communication can be achieved with a conventional needle holder, a blood collection set or other known means. In the illustrated example, closure enables the 3.5 mL fluid sample to be collected, while retaining a head space of approximately 5-16 mm (i.e., 0.8-1.5 mL).

Figure 7:
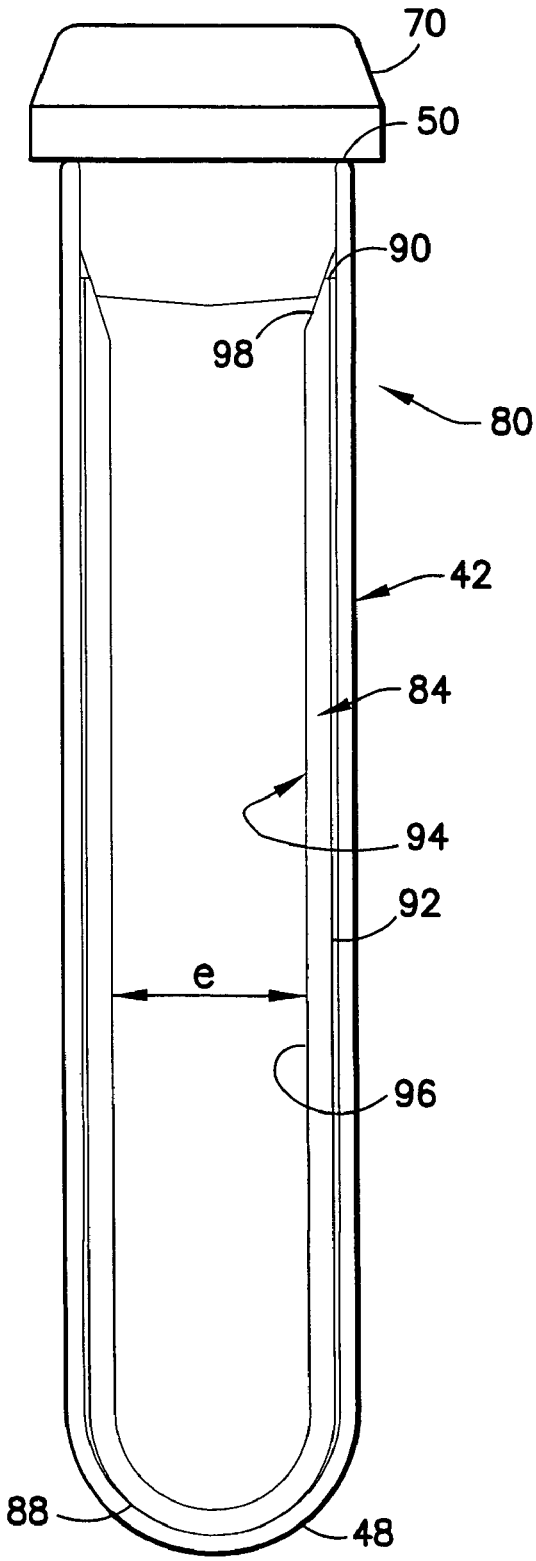
FIG. 7 is a longitudinal cross-sectional view of a third embodiment of a container assembly in accordance with the subject invention.

FIG. 7 illustrates a tube assembly 80 that is similar to tube assembly 40. In particular, tube assembly 80 includes an outer tube 42 identical to outer tube 42 described above with respect to FIG. 5. Tube assembly 80 further includes an inner tube 84 that is similar to inner tube 44 of tube assembly 40. In particular, inner tube 84 has a tubular sidewall 86, a closed bottom 88 and an open top 90. Tubular sidewall 86 has an outer surface 92 that may be substantially identical to the outer surface 62 of inner tube 40. Inner tube 84 further includes an inner surface 94 with a cylindrically generated section 96 adjacent closed bottom 84 and an outwardly tapered section 98 adjacent open top 90. Cylindrically generated section 96 of inner surface 94 defines an inside diameter "e" that is less than inside diameter "d" of cylindrical portion 66 on inner surface 64 of inner tube 44. As a result, tube assembly 70 can accommodate a volume of about 3.0 mL while achieving a head space of 5-16 mm (i.e., 0.8-1.5 mL) substantially equal to the head space achieved with tube assembly 40.

Figure 8:
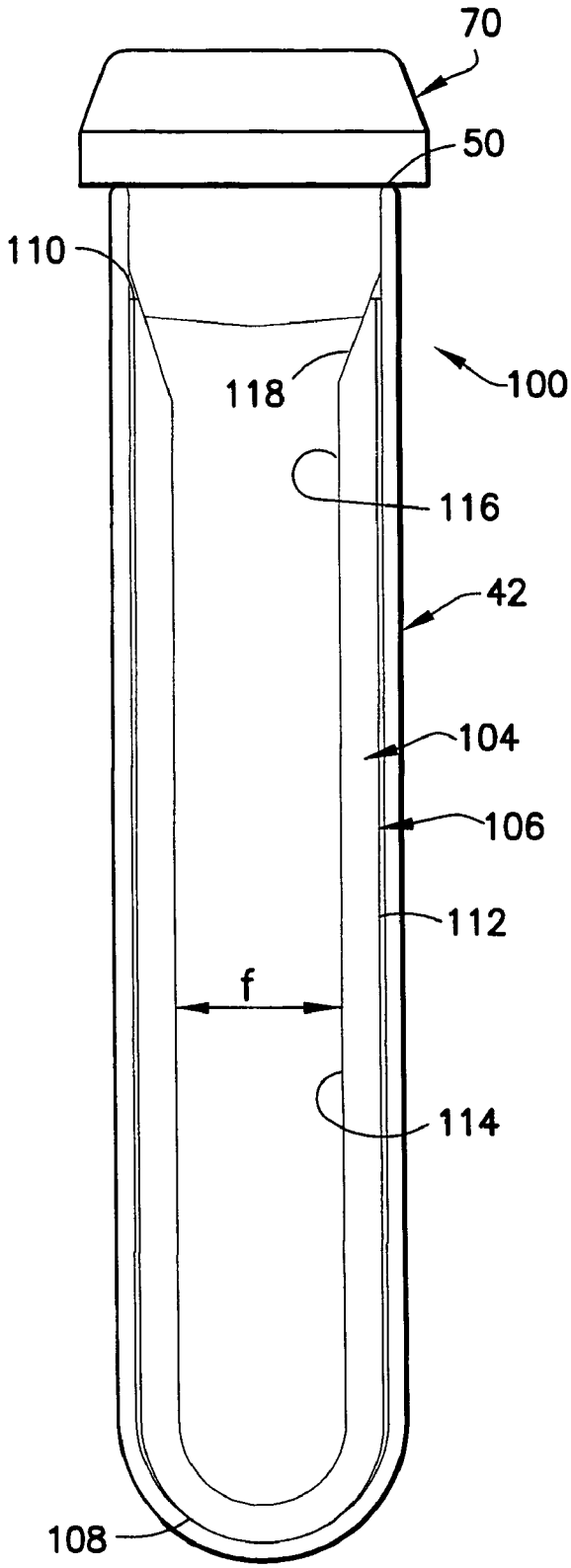
FIG. 8 is a longitudinal cross-sectional view of a fourth embodiment of a container assembly in accordance with the subject invention.

FIG. 8 shows a tube assembly 100 with an outer tube 42 substantially identical to outer tube 42 of tube assemblies 40 and 80. Tube assembly 100 also includes an inner tube 104 that has a tubular sidewall 106, a closed bottom 108 and an open top 110. Tubular sidewall 106 has an outer surface 112 that may be substantially identical to outer surface 62 of sidewall 56 on inner tube 44. Tubular sidewall 106 further has an inner surface 114 with a cylindrically generated section 116 adjacent closed bottom 108 and an outwardly flared section 118 adjacent open top 110. Cylindrically generated section 116 of inner surface 114 defines an inside diameter "f" that is less than inside diameter "e" of inner tube 84. As a result, tube assembly 100 can accommodate a fluid sample of only about 2.0 ml, while achieving a head space of 5-16 mm (i.e., 8-1.5 mL) substantially equal to the head spaces of the tube assemblies 40 and 80.

The system of tubes depicted in FIGS. 5-8 enables collection of a fluid sample of appropriate size for a particular laboratory test to be performed, but without affecting the head space.

Figure 9:
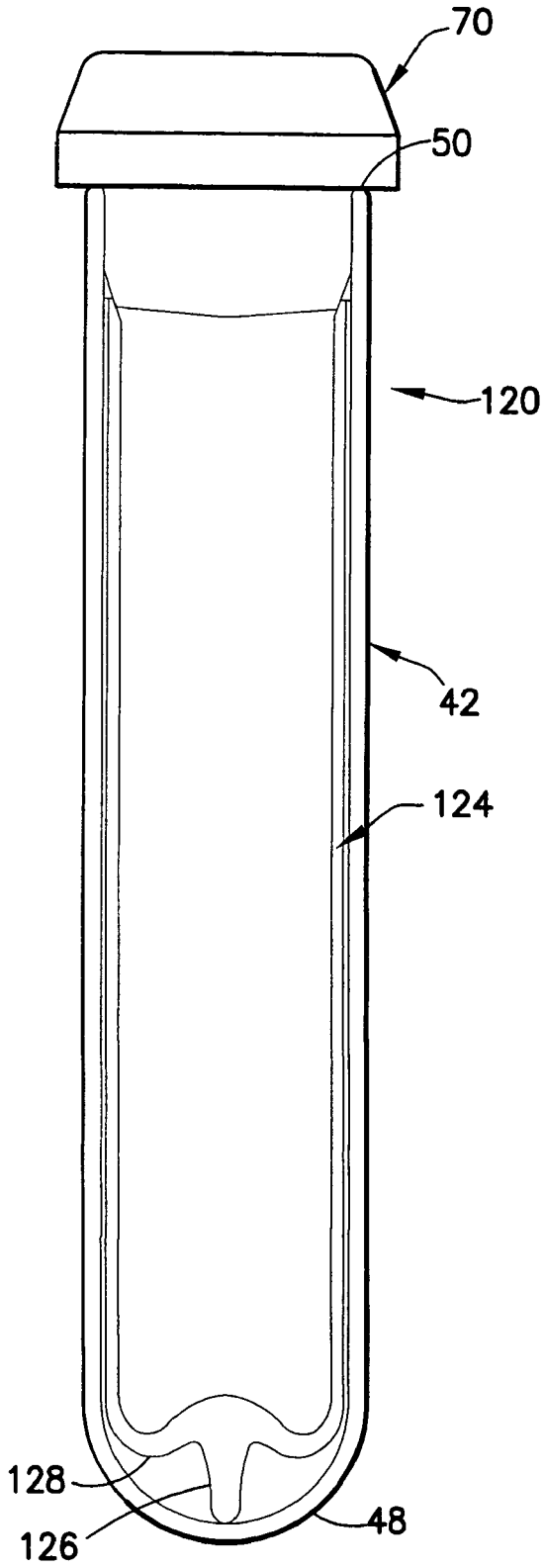
FIG. 9 is a longitudinal cross-sectional view of a fifth embodiment of a container assembly in accordance with the subject invention.

The reduced volume and substantially uniform head space can be achieved by providing an effectively thicker bottom wall as shown in FIG. 9 instead of or in addition to the variable thickness of the sidewalls. In particular, FIG. 9 shows a tube assembly 120 with an outer tube 42 substantially identical to the outer tube 42 shown in FIGS. 5-8. Additionally, tube assembly 120 includes a closure 70 that may be substantially identical to the closures shown in FIGS. 5-8. Tube assembly 120 further includes an inner tube 124 with a projection 126 at the closed bottom end thereof. As a result, a raised bottom wall 128 is spaced considerably above closed bottom 48 of outer tube 42. Accordingly, inner tube 124 defines a smaller volume than inner tube 44 in the embodiment of FIGS. 5 and 6 without an increase in wall thickness. Furthermore, the projection 126 enables the closed bottom of inner tube 124 to be raised without a significant increase in thickness of inner tube 124. In this latter regard, a significantly increased thickness at the bottom of inner tube 124 could complicate molding.

Figure 10:
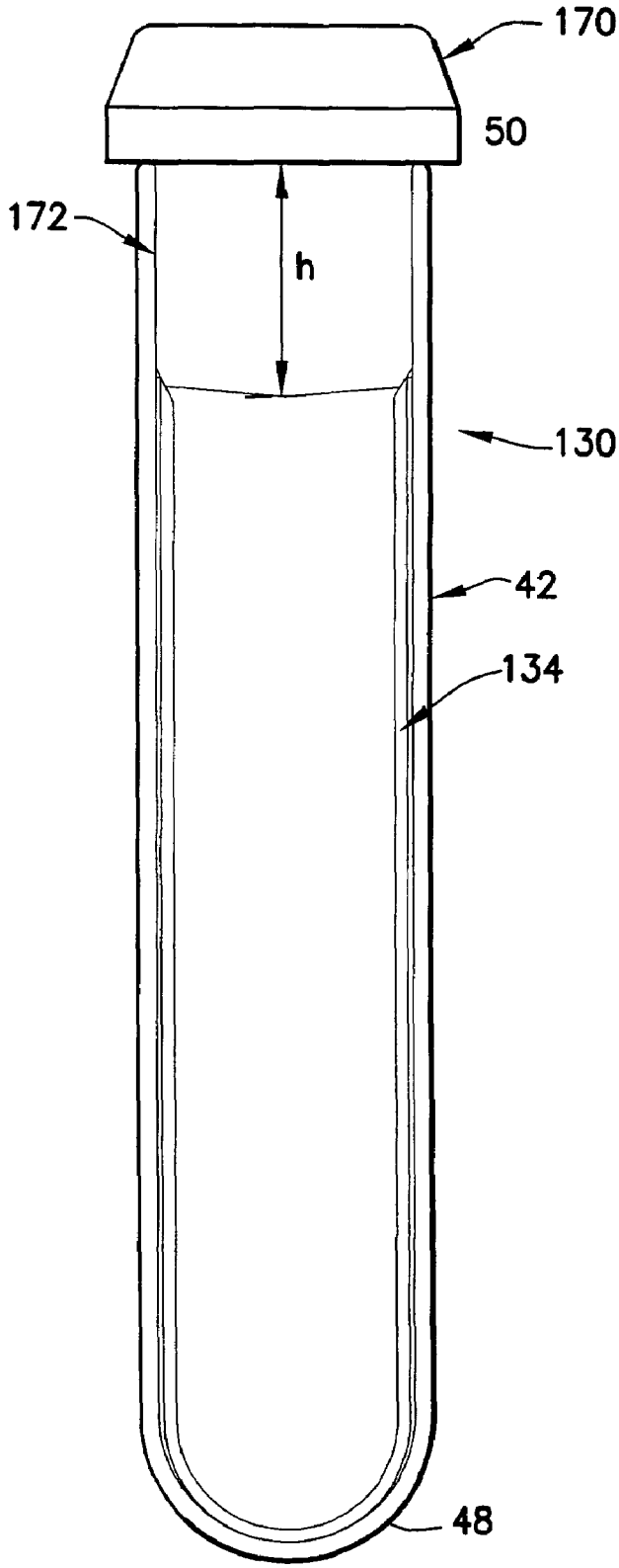
FIG. 10 is a longitudinal cross-sectional view of a sixth embodiment of a container assembly in accordance with the invention.

The container of the subject invention may include closures that extend greater distances into the container for reducing the head space and achieving a substantially uniform head space for different volumes of fluid. In particular, FIG. 10 shows a container assembly 130 with an outer tube 42 substantially identical to the outer tube of the embodiments shown in FIGS. 5-9. Assembly 130 further includes an inner tube 134 that is very similar to inner tube 44 in the embodiment of FIGS. 5 and 6. However, inner tube 134 is shorter than inner tube 44. Tube assembly 130 further includes a closure 170 that is similar to closure 70 on the embodiments of FIGS. 5-9. However, closure 170 includes an internal section 172 with a length "h" that exceeds the corresponding length of closure 70 shown in the embodiments of FIGS. 5-9. The greater length "h" compensates for the shorter length of inner tube 134 and effectively reduces both the volume of tube assembly 134 and the head space. The different length closures 170 can be used with or instead of the different effective thicknesses for the bottom wall (FIG. 9) and/or the different thicknesses for the sidewalls (FIGS. 5-8).

What is claimed is:

1. A plurality of container assemblies comprising at least a first container assembly and a second container assembly, each of said container assemblies in said plurality having an outer container and an inner container nested within said outer container, said outer containers of each of said container assemblies having substantially identical external dimensions, said inner container of said first container assembly being configured to define a first volume for said first container assembly, said inner container of said second container assembly being configured to define a second volume for said second container assembly, said second volume being less than said first volume.

2. The plurality of container assemblies of claim 1, wherein each said container assembly further comprises a closure, the closures of said first and second container assemblies being substantially identical.

3. The plurality of container assemblies of claim 1, wherein the inner container of the first container assembly has a sidewall with a first thickness, the inner container of the second container assembly having a sidewall of a second thickness, the second thickness being greater than the first thickness.

4. The plurality of container assemblies of claim 1, wherein the outer container of each said container assembly has a closed bottom and an open top, the inner container of each said container assembly having a bottom wall at least partly nested with the closed bottom of the outer container of the respective container assembly, the bottom wall of the inner container of the first container assembly being spaced a first distance from the open top of the outer container of the first container assembly, the bottom wall of the inner container of the second container assembly being spaced a second distance from the open top of the outer container thereof, the second distance being less than the first distance.

5. The plurality of container assemblies of claim 4, wherein the bottom wall of the inner container of the second container assembly includes a projection extending into nested engagement with the closed bottom of the outer container of the second container assembly.

6. The plurality of container assemblies of claim 5, wherein the projection has a thickness substantially equal to thicknesses existing at other locations on the inner container of the second container assembly.

7. The plurality of container assemblies of claim 1, wherein the inner container of the first container assembly has a closed bottom and an open top and defining a first length therebetween, the inner container of the second container assembly having a closed bottom and an open top and defining a second length therebetween, the second length being less than the first length.

8. The plurality of container assemblies of claim 7, wherein the first container assembly has a first closure and the second container assembly has a second closure, the first and second closures extending into sealing engagement with the open tops of the inner containers in the respective first and second container assemblies, the second closure being longer than the first closure.

9. The plurality of container assemblies of claim 1, wherein the inner container of each of said container assemblies has a plurality of surface of discontinuities for permitting an escape of air as the inner container is nested into the outer container of the respective container assembly.

10. The plurality of container assemblies of claim 1, wherein the outer container of each said container assembly is a tube with a substantially cylindrical sidewall.

11. The plurality of container assemblies of claim 10, wherein the inner container of each said container assembly is a tube with a substantially cylindrical sidewall, inner surface regions of each said inner container defining an outwardly tapering open top for sealing engagement with a closure.

12. The plurality of container assemblies of claim 1, wherein the outer container of each said container assembly is formed from a first material and wherein the inner container of each said container assembly is formed from a second material different from said first material.

13. First and second container assemblies for containing first and second volumes of liquid, said first and second container assemblies having substantially identical outer containers, inner containers nested in the respective outer containers and configured respectively for defining a first inner volume for said first container assembly and a second inner volume for said second container assembly, said second inner volume being less than said first inner volume by an amount substantially corresponding to a difference between said first and second volumes of liquid.

14. The container assemblies of claim 13, further comprising first and second closures for closing the respective first and second container assemblies, said first and second container assemblies defining substantially identical head spaces adjacent said closures when the respective first and second volumes of liquid are in the first and second container assemblies.

15. A plurality of containers comprising at least one first container and at least one second container, each of said containers having a container wall with opposite outer and inner surfaces and defining a wall thickness between said outer and inner surfaces, each of said containers having substantially identical external dimensions defined by said outer surfaces of said container walls, said first container having a first wall thickness for defining a first internal volume for said first container, said second container having a second wall thickness greater than said first wall thickness for defining a second internal volume for said second container, said second internal volume being less than the first internal volume, whereby said first and second containers enable collection of first and second volumes of material with substantially identical head spaces in the respective container.

16. The plurality of containers of claim 15, wherein each said container is formed from a first plastic material adjacent said outer surface and a second plastic material adjacent said inner surface.

17. The plurality of containers of claim 16, wherein said first plastic for each of said containers is of substantially identical thickness.

18. The plurality of containers of claim 16, wherein said first and second plastics are molded to define an integral matrix of plastic material between said inner and outer surfaces of each of said containers.

19. A plurality of container assemblies, each of said container assemblies defining a container with a closed bottom, an open top and a sidewall extending between said closed bottom and said open top, each said container further having a closure sealingly engaged in said open top of said container, at least a first of said closures being dimensioned to extend a first distance into the open top of the respective container, and at least a second closure being dimensioned to extend a second distance into the open top of the respective container, said second distance being greater than said first distance such that the container with said second closure defines an inner volume smaller than the container with said first closure.

20. The plurality of container assemblies of claim 19, wherein all of said containers are substantially identical.

21. The plurality of containers of claim 19, wherein each of said containers is unitarily molded from a plastic material.

22. The plurality of containers of claim 19, wherein each of said containers is molded to define an outer tube formed from a first plastic material and an inner tube formed from a second plastic material, said first and second plastic materials defining an integral matrix of plastic throughout each of said containers.

23. The plurality of container assemblies of claim 19, wherein each of said containers comprises an outer tube and an inner tube nested within said outer tube.

24. A method for collecting a sample of liquid comprising:

providing a plurality of substantially identical outer containers;

providing a plurality of inner containers, each of said inner containers being dimensioned for nested engagement within any of said outer containers, at least a first of said inner containers defining a smaller interior volume than at least a second of said inner containers;

determining a required volume for a liquid sample;

selecting an appropriate one of said inner containers with a volume greater than the required volume by an amount sufficient for achieving a specified head space;

inserting the selected inner container into any of said outer containers to define a container assembly; and collecting the selected volume of said liquid in the container assembly for achieving the specified head space in said container assembly.

25. The method of claim 24, further comprising closing the container assembly.

26. A method for collecting a sample of liquid comprising:

providing at least first and second containers having substantially identical outer dimensions and having at least first and second different internal volumes;

determining a required volume for a liquid sample;

selecting an appropriate one of said containers with a volume greater than the required volume by an amount for achieving a specified head space;

collecting the selected volume of said liquid in said container for achieving the specified head space in the container.

27. The method of claim 26, wherein the step of providing at least first and second containers comprises providing a plurality of containers each of which has a container with a closed bottom, an open top and a sidewall extending between said closed bottom and said open top, each said container further having a closure sealingly engaged in said open top.

28. The method of claim 27, wherein each of said containers is an evacuated container, and wherein the step of collecting the selected volume of liquid comprises placing the evacuated container in communication with a source of the liquid.

29. The method of claim 27, wherein the step of providing a plurality of containers comprises providing a plurality of containers each of which is molded unitarily from a plastic material.

30. The method of claim 27, wherein the step of providing a plurality of containers comprises providing a plurality of containers each of which has an outer container formed from a first plastic and an inner container formed from a second plastic.

31. The method of claim 30, wherein the first and second plastics are molded to define an integral matrix of plastic extending between inner and outer surfaces of the respective container.

32. The method of claim 27, wherein the different volumes for said container assemblies are achieved by providing a plurality of differently dimensioned closures.

33. The method of claim 26, further comprising providing at least a third container having a third internal volume different from the first and second internal volumes.

* * * * *